United States Patent [19]

Butzen

[11] 4,000,894

[45] Jan. 4, 1977

[54] GAME BALL

[75] Inventor: Kenneth B. Butzen, Des Plaines, Ill.

[73] Assignee: Pepsico, Inc., Purchase, N.Y.

[22] Filed: June 23, 1975

[21] Appl. No.: 589,189

[52] U.S. Cl. ..... 273/65 EG; 273/65 EB

[51] Int. Cl.[2] ..... A63B 41/00; A63B 45/02

[58] Field of Search ..... 273/65 EG, 65 E, 58 K, 273/65 EF, 65 EE, 65 ED, 65 EC, 65 EB

[56] References Cited

UNITED STATES PATENTS

| | | | |
|---|---|---|---|
| 1,543,724 | 6/1925 | Roberts et al. | 273/65 EG |
| 2,011,760 | 8/1935 | Gallinant | 273/65 EG |
| 2,187,524 | 1/1940 | Price | 273/58 K X |
| 2,494,806 | 1/1950 | Gibson | 273/65 EG |
| 3,119,618 | 1/1964 | Molitor et al. | 273/65 E |
| 3,512,777 | 5/1970 | Henderson | 273/65 EG |

FOREIGN PATENTS OR APPLICATIONS

| | | | |
|---|---|---|---|
| 600,722 | 6/1960 | Canada | 273/65 EG |

*Primary Examiner*—George J. Marlo
*Attorney, Agent, or Firm*—Hill, Gross, Simpson, Van Santen, Steadman, Chiara & Simpson

[57] ABSTRACT

Inflatable play balls having improved handling properties and comprising a flexible bladder, a valve for introducing air into the bladder, and a cover over the bladder, the cover having a pebble grain configuration including raised pebble surfaces separated by depressions between the individual pebble surfaces, the raised pebble surfaces having a either a flat or concave configuration.

5 Claims, 5 Drawing Figures

GAME BALL

BACKGROUND OF THE INVENTION

1. Field of the Invention

This invention is in the field of inflatable play balls, particularly those such as footballs and basketballs in which accurate throwing comes from proper handling and spin imparted to the ball, although the invention is also applicable to other inflatable balls such as soccer balls and volleyballs. The invention is primarily concerned with a cover on such a ball which has a pebble grain configuration, wherein the land portions or pebble surfaces of the ball surface are substantially flat or concave.

2. Description of the Prior Art

With such a heavy emphasis on passing in modern football, there has been a continued emphasis on making the football easier to handle, enabling the passer to get the pass away with better control of its accuracy. Some of this development has gone into reshaping the ends of the ball so that they encounter less wind resistance as they travel through the air.

Equally important to the passer is the feel of the ball in his hand as he prepares to get rid of the ball. Present-day balls are usually designed with a pebble grain cover composed of leather, rubber or vinyl resin, the pebble graining serving to improve the firmness of the grip which the player can apply to the ball, as compared with a smooth surfaced ball. Such pebble graining is uaually achieved by passing the leather stock through suitable embossing rolls or by stamping under heat and pressure with an embossing plate or mold to provide a random pattern of raised pebble surfaces separated by a maze of depressions between the raised pebble surfaces. Heretofore, however, these raised pebble surfaces have been in the form of convex surfaces, even approaching a semi-spherical form. The present invention is based upon the discovery that the convex configuration in the individual pebble surfaces is not the ideal configuration, and significantly improved results can be achieved as far as handleability of the ball is concerned if the pebble surfaces are made flat (planar) or concave.

SUMMARY OF THE INVENTION

The present invention provides an improved inflatable play ball of the type which includes a flexible bladder and valve means for introducing air into the bladder. A cover, composed of leather or rubber is formed over the bladder and is connected thereto usually through a woven carcass. The exterior of the cover has raised pebble surfaces separated by random depressions, there being approximately two hundred raised pebble surfaces per square inch of the cover. The depth of the depressions usually ranges from about 0.016 to 0.026 inch. The width of the raised pebble surfaces is from about 0.080 to 0.100 inch. The improved ball handling characteristics of the present invention are provided by shaping the pebble surfaces such that they have either a substantially flat or a concave configuration.

BRIEF DESCRIPTION OF THE DRAWINGS

Other objects, features and advantages of the invention will be readily apparent from the following description of certain preferred embodiments thereof, taken in conjunction with the accompanying drawings, although variations and modifications may be effected without departing from the spirit and scope of the novel concepts of the disclosure, and in which.

DESCRIPTION OF THE PREFERRED EMBODIMENTS

Figure 1:
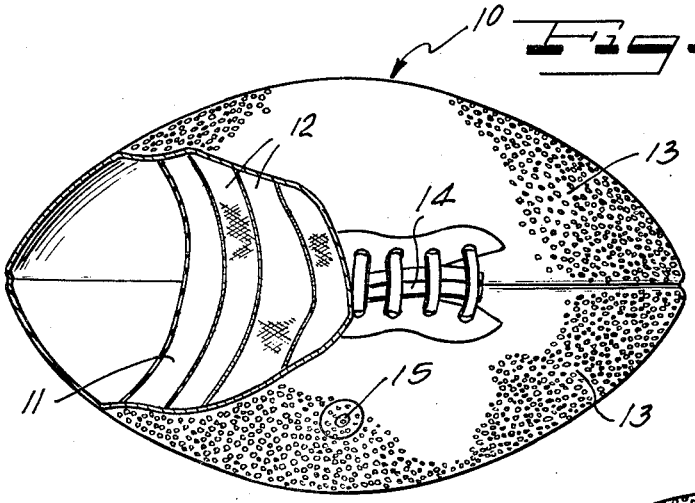
FIG. 1 is a plan view of a football embodying the improvements of the present invention, portions thereof being broken away to expose the various layers.

In FIG. 1 reference numeral 10 indicates generally a professional type football of the type to which the improvements of the present invention can be applied. The interior of the ball 10 includes a flexible bladder 11 composed of butyl rubber or the like. Overlying the bladder 11 are a plurality of plies 12 of a fabric such as cotton twill which are applied in cross-grained relation and bonded together. Overlying the twill 12 is a cover composed of a plurality of panels 13 which are stitched together and bonded to the underlying twill 12. The usual laces 14 are provided on the top of the ball as well as the usual valve 15 for introducing air into the interior of the bladder 11.

Figure 2:
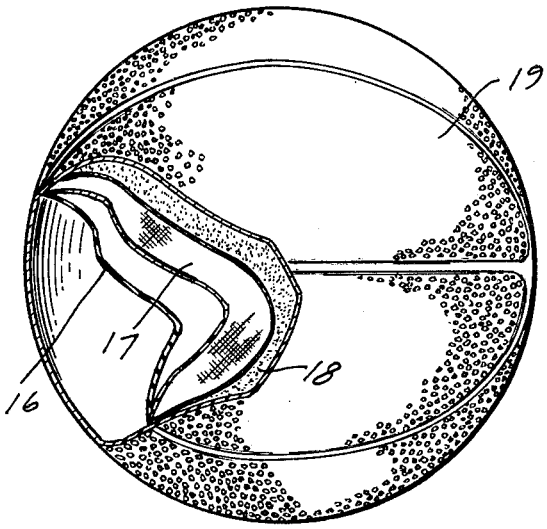
FIG. 2 is a view similar to FIG. 1 except that it shows a basketball construction according to the present invention.

A typical basketball construction to which the improvements of the present invention can be applied is illustrated in FIG. 2. The basketball includes a bladder 16 composed of butyl rubber or the like over which there is a layer of nylon windings 17. A layer of bonding agent 18 seals the windings and acts as an adhesive base for a cover 19 composed of leather or rubber. The cover 19 is conventionally composed of a plurality of panels which are stitched together.

Figure 3:
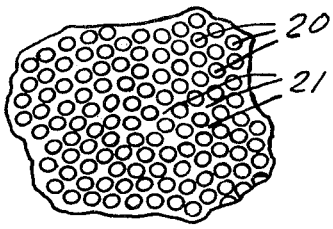
FIG. 3 is a fragmentary plan view on an enlarged scale of the pebble grain configuration present on the cover of the balls shown in FIG. 1 or 2.

The pebble grain configuration of the cover of both the football and the basketball shown in FIGS. 1 and 2 is illustrated in FIG. 3. As shown in that figure, there are a plurality of raised pebble surfaces 20 separated by randomly arranged depressions 21. The pebble graining can be accomplished by means of suitable embossing rolls. Generally, there are about two hundred of the raised surfaces 20 per square inch of cover.

Figure 4:
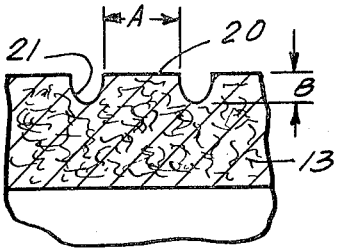
FIG. 4 is a highly magnified view of the pebble grain surface itself illustrating one form of the invention.

In the enlarged view of FIG. 4, there is shown the raised surfaces 20 and the depressions 21, with the raised surfaces 20 being substantially flat. The width of individual pebble grains, indicated by the dimension A is preferably on the order of 0.080 to 0.100 inch while the depth, illustrated by dimension B is from about 0.016 to 0.026 inch. The walls of the depressions 21 may be curved as illustrated in FIG. 4, or they may be straight.

Figure 5:
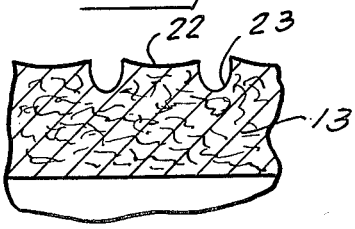
FIG. 5 is a view similar to FIG. 4 but illustrating a second form of the invention.

In the form of the invention illustrated in FIG. 5, there are raised surfaces 22 and random depressions 23, with the raised surfaces 22 being slightly concave. This concavity can be embossed into the cover initially although even when the surfaces are made flat as illustrated in FIG. 4, the act of inflating the ball may stretch the cover to an extent to provide concave surfaces in the head of the pebble.

Tests employing a football made according to the present invention made by skilled passers established that the ball of the present invention provides a firmer grip of the hand and a feeling of better control so that the passer can be more accurate and provide a better spin on the ball.

Laboratory tests were also made to compare a conventional ball having a spherical pebble grained surface with a ball having flat pebble surfaces. The balls were tested on an inclined plane having a surface similar to the texture of the human hand. The static friction was found to be substantially the same for both types of balls, but the flat pebbled ball evidenced a dynamic friction about 8 to 10% greater than the spherical pebbled ball.

It should be evident that various modifications can be made to the described embodiments without departing from the scope of the present invention.

I claim as my invention:

1. An inflatable play ball comprising a flexible cover, and valve means for introducing air into said ball, said cover having a pebble grain configuration including raised pebble surfaces separated by depressions between the individual pebble surfaces, the upper ends of said raised pebble surfaces having either a substantially flat or concave configuration, said raised pebble surfaces extending about the entire periphery of the ball and being integral therewith, said pebble grain configuration increasing the dynamic friction characteristics of the ball thereby improving the handling characteristics of the ball.

2. The play ball of claim 1 in the shape of a football.

3. The play ball of claim 1 in the shape of a basketball.

4. The play ball of claim 1 in which said cover is composed of leather.

5. The play ball of claim 1 in which said cover is composed of rubber.

* * * * *